US009551168B2

(12) United States Patent
Dias

(10) Patent No.: US 9,551,168 B2
(45) Date of Patent: Jan. 24, 2017

(54) FURNITURE EMBEDDED LOCKING DEVICE

(71) Applicant: Fernando Da Silva Dias, Witney (GB)

(72) Inventor: Fernando Da Silva Dias, Witney (GB)

( * ) Notice: Subject to any disclaimer, the term of this patent is extended or adjusted under 35 U.S.C. 154(b) by 239 days.

(21) Appl. No.: 14/546,435

(22) Filed: Nov. 18, 2014

(65) Prior Publication Data

US 2016/0138300 A1 May 19, 2016

(51) Int. Cl.

| | |
|---|---|
| ***E05B 65/44*** | (2006.01) |
| ***E05B 65/46*** | (2006.01) |
| ***E05B 37/00*** | (2006.01) |
| ***E05B 47/00*** | (2006.01) |
| ***E05B 49/00*** | (2006.01) |
| ***E05B 55/00*** | (2006.01) |
| ***E05B 47/06*** | (2006.01) |
| ***G07C 9/00*** | (2006.01) |

(52) U.S. Cl.

CPC ..... *E05B 65/46* (2013.01); *E05B 37/00* (2013.01); *E05B 47/0001* (2013.01); *E05B 47/0611* (2013.01); *E05B 49/00* (2013.01); *E05B 55/005* (2013.01); *G07C 9/0069* (2013.01); *G07C 9/00563* (2013.01); *E05B 65/44* (2013.01); *E05B 2047/0072* (2013.01); *Y10T 70/5128* (2015.04); *Y10T 70/7068* (2015.04)

(58) Field of Classification Search

CPC ..... E05B 65/44; E05B 65/46; E05B 65/461; E05B 47/0611; E05B 47/0001; E05B 49/00; E05B 37/00; E05B 55/005; E05B 2047/0072; G07C 9/00563; G07C 9/0069; Y10T 70/5128; Y10T 70/5133; Y10T 70/5137; Y10T 70/5142; Y10T 70/5097; Y10T 70/5111; Y10T 70/7068; Y10T 70/7057; Y10T 70/7102

USPC ... 70/77–88, 446, 333 R, 333 A, 277, 278.1, 70/278.7, 279.1, 280–282; 292/144; 340/5.52, 5.53, 5.82, 5.83; 312/215, 222, 312/333

See application file for complete search history.

(56) References Cited

U.S. PATENT DOCUMENTS

| | | | | |
|---|---|---|---|---|
| 1,512,937 | A | 10/1924 | Knaster | |
| 5,206,637 | A * | 4/1993 | Warren | G07C 9/00817 312/222 |
| 7,826,220 | B1 | 11/2010 | Baker | |
| 2004/0012482 | A1* | 1/2004 | Yamagishi | G07C 9/00166 340/5.53 |
| 2005/0113970 | A1* | 5/2005 | Holmes | A47B 88/00 700/242 |
| 2010/0079046 | A1 | 4/2010 | Vint | |
| 2013/0133558 | A1 | 5/2013 | Andrews | |
| 2013/0229098 | A1 | 9/2013 | Pletcher | |

FOREIGN PATENT DOCUMENTS

| | | |
|---|---|---|
| WO | 2010141201 | 12/2010 |

* cited by examiner

*Primary Examiner* — Lloyd Gall
(74) *Attorney, Agent, or Firm* — Lambert & Associates; Gary E. Lambert; David J. Connaughton, Jr.

(57) ABSTRACT

A locking device to secure a compartment which allows an intelligent interaction with the user. The locking device may be incorporated into a furniture or other structure requiring locking to prevent and allow access to the compartment.

20 Claims, 12 Drawing Sheets

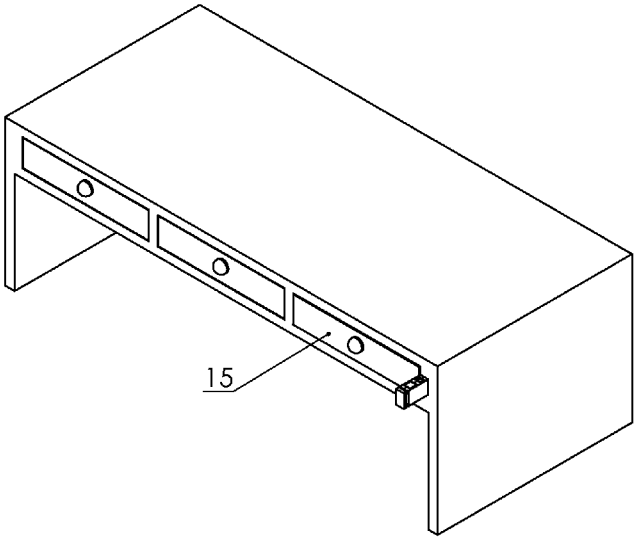
Figure 10a
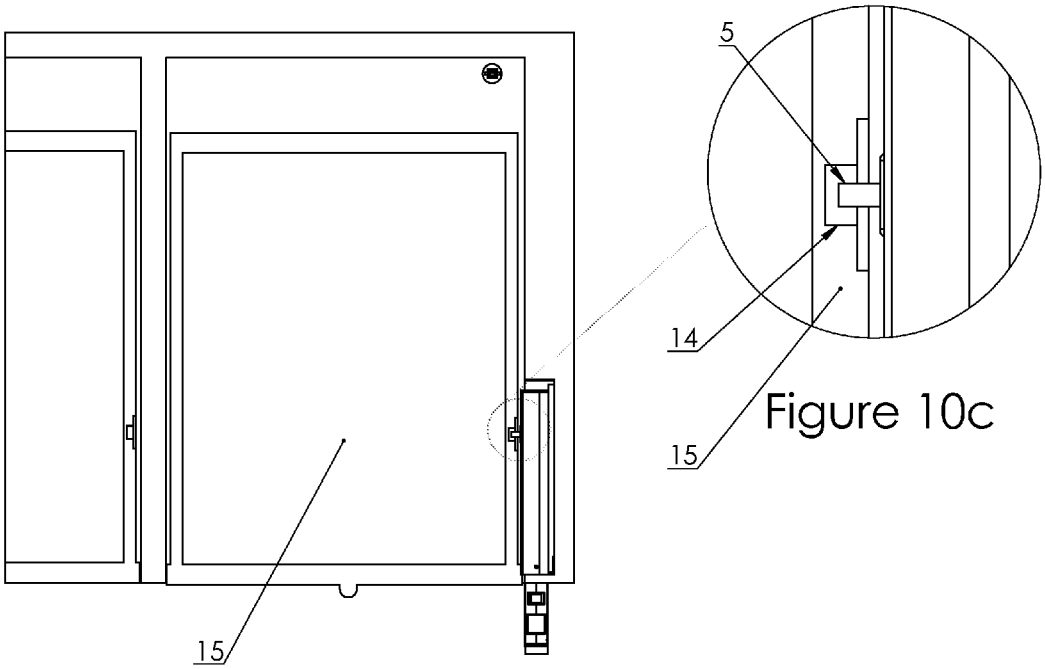
Figure 10c
Figure 10b

FURNITURE EMBEDDED LOCKING DEVICE

BACKGROUND OF THE INVENTION

Field of the Invention

The present invention relates generally to locking security device. More particularly, the present invention relates to a locking security device integrated into a piece of furniture for locking a furniture compartment.

Description of Related Art

Security devices are a necessity in today's world where valuables are at a constant threat of being stolen, even in the safety of one's home. While furniture is good for hiding valuables from plain sight, it is also the first place a thief may look to find these valuables. As such, locking furniture is very important for keeping these valuables.

Many furniture devices have simple locks on them such as keyed locks. These may be satisfactory for the storage of low-security items, however, for a determined thief, they are no deterrent. Further, such keyed and other security systems are highly visible, and are generally bad-looking and inelegant.

Therefore, what is needed is a device that provides a high level of intelligent security to a furniture piece, controlling access to a furniture compartment therein. Further, what is needed is a locking security device that is integrated into the furniture and relatively hidden, so that it is not readily apparent how it may be accessed.

SUMMARY OF THE INVENTION

The subject matter of this application may involve, in some cases, interrelated products, alternative solutions to a particular problem, and/or a plurality of different uses of a single system or article.

In one aspect, a locking security device is provided. The locking device comprises a primary block which defines the body and exterior structure of the device. A locking piston (dead bolt, piston, or related locking structure) moves in a perpendicular direction with respect to the length of the primary block. The locking piston is movable between a locked position, and unlocked position. An interface block is movably positioned within the primary block, and can move between a home position within the primary block, and an access position when extending out of the primary block. An access sensor, in the exterior and on the front face of the interface block, once activated allows the interface block to move from home to access position.

The interface block comprises a display and at least one of a biometric sensor, a keypad and a near field communication sensor. These components are exposed when the interface block is in the access position, and hidden when in the home position. Only the near field communication sensor is accessible in any position of the interface block. Once the interface block components are exposed, upon an activation of the at least one of the keypad, the biometric sensor and the near field communication sensor, the locking piston is configured to move to the unlocked position, thereby unlocking the secured furniture compartment.

In another aspect, a furniture having the locking device installed is provided. The furniture is configured with the security device installed such that the locking piston is engaged with a slot of a drawer, door, or other closure of a furniture when in the home position. The locking piston is removed from this slot when in the unlocked position, allowing normal operation of the closure. Further, the device is installed so that the interface block is extended out of, and away from, the furniture when in the access position, providing access to the interface block components.

In yet another aspect, a method of operation of the furniture having the locking device installed is provided. The method involves activating the configured access sensor, thereby moving the interface block to its access position from the home position. Once in the access position, the interface block user interface components may be activated in order to unlock the locking piston. Once they are activated, the locking piston may move automatically from the locked to unlocked position based on a valid input from the activation of at least one of the biometric sensor, the keypad and the near field communication sensor. This moving may be controlled by a speed and position controller in communication with at least one of the biometric sensor, the keypad and the near field communication sensor. Once unlocked, the drawer or other closure of the furniture may be opened and accessed. After this is done, the furniture compartment may be closed, and when in the correct position and effectively closed, the locking piston may return to its locked position interfacing with the slot of the drawer. Finally, once the locking piston is engaged, the interface block may be retracted within the primary block to its home position.

BRIEF DESCRIPTION OF THE DRAWINGS

FIGS. 10*a*-10*c* provide perspective, elevation and detail views of a furniture with an embodiment of the present invention installed therein.

DETAILED DESCRIPTION

Figure 1:
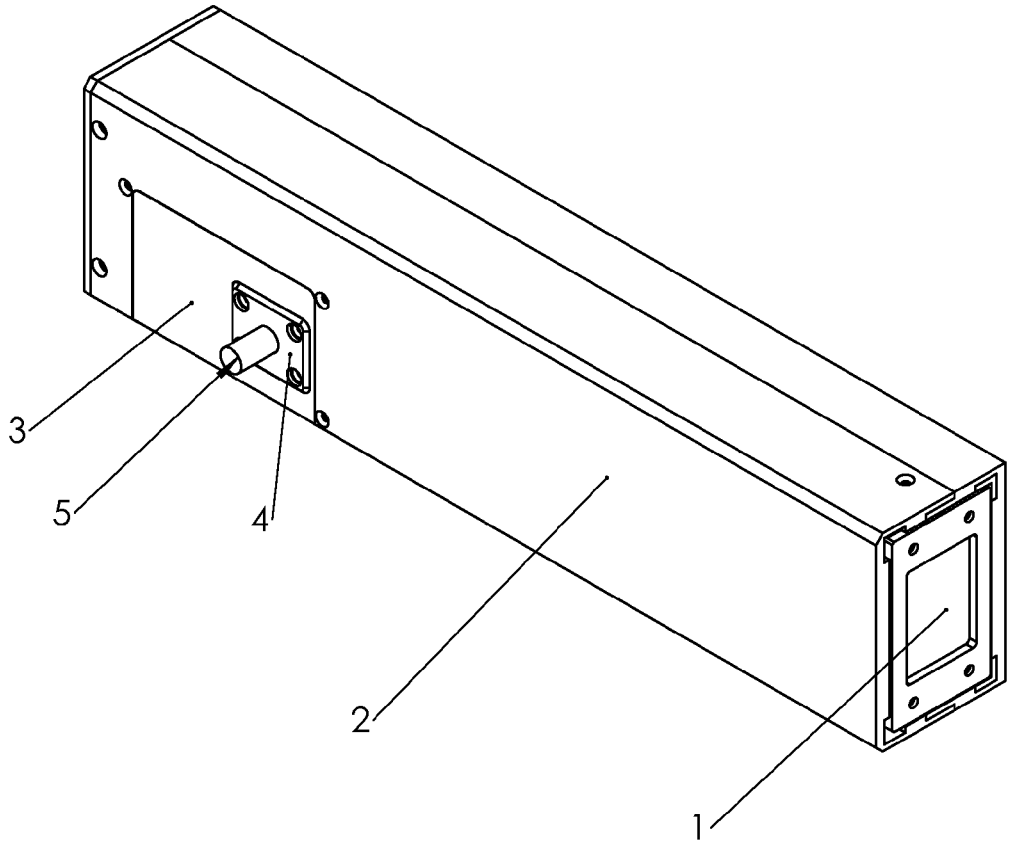
FIG. 1 provides a perspective view of an embodiment of the present invention.
Figure 2:
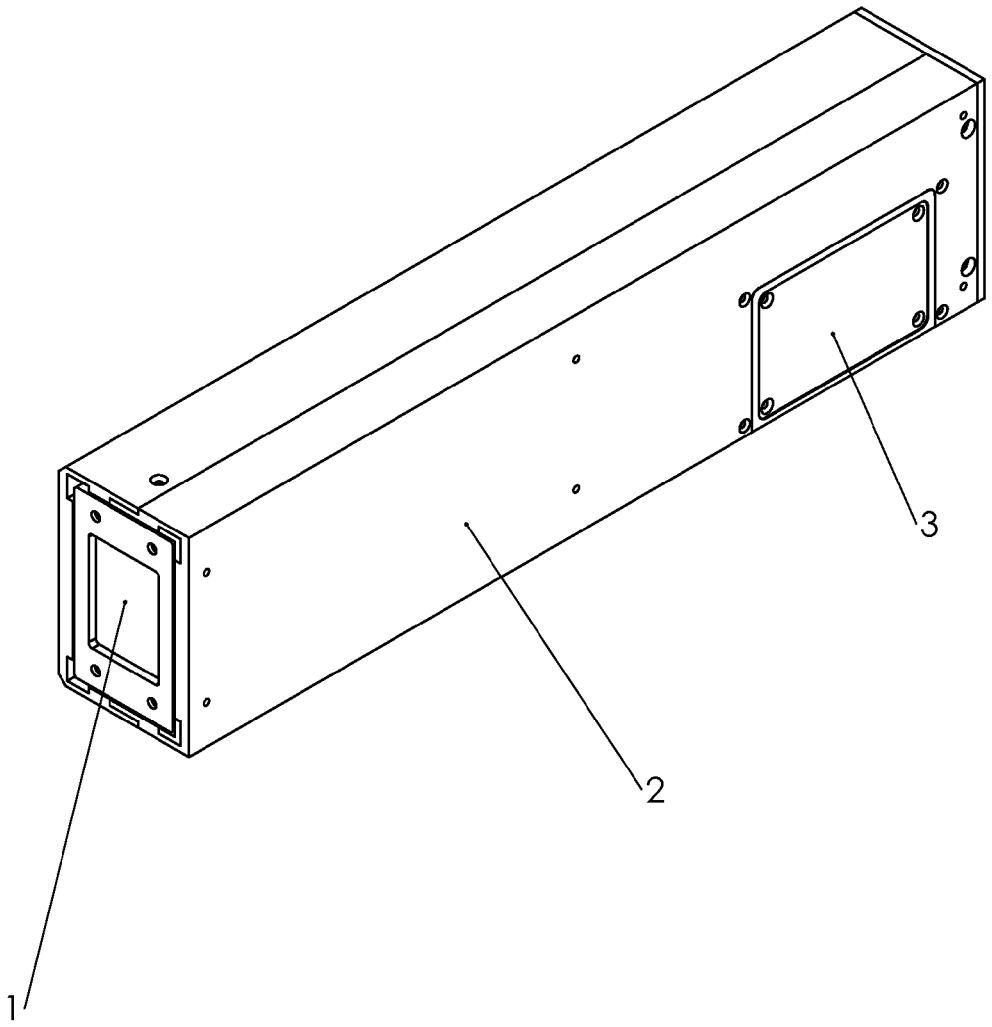
FIG. 2 provides a perspective view of another embodiment of the present invention.
Figure 3:
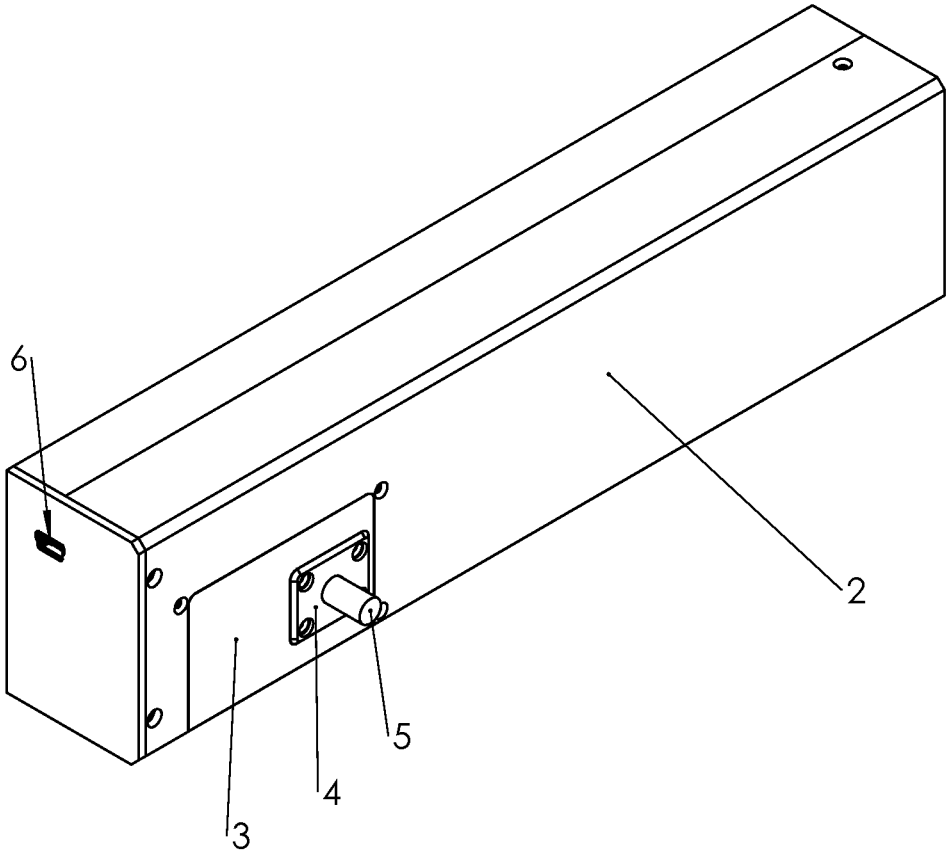
FIG. 3 provides a perspective view of yet another embodiment of the present invention.
Figure 4:
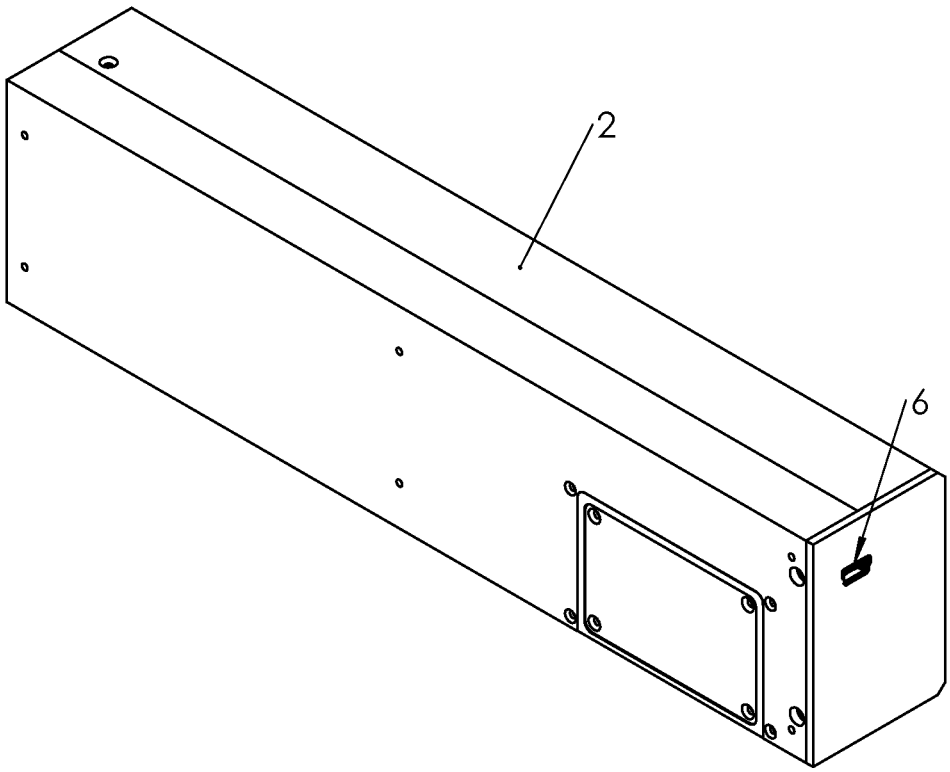
FIG. 4 provides a perspective view of still another embodiment of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a locking security device that controls access to a lockable compartment 15 in a piece of furniture. The device is compact, portable, and may have multiple stages of security required to access the compartment. These stages may utilize systems such as an access sensor 1 (near field communication sensor, touch control sensor and/or push sensor), biometric sensors 9, keypad 8 and the like. The locking security device is a compact and portable piece which can be easily adapted to any type of furniture including antique furniture. The invention is embedded in the furniture without disturbing its design. The security device is intended to be subtle and camouflaged, and at least not apparent, within the design of the furniture.

The security device contemplated herein is configured to be hidden in a piece of furniture when in a secured mode, and accessible when in an unsecured mode, only when the locking piston 5 is disengaged with locking slot 14. In many embodiments, the security device will have two stages of security before a locked compartment 15 of the furniture may be accessed. The first stage when the interface block 7 moves from hidden to accessible, the interface block 7 is then said to be in access position. The second stage takes place when the authorized user is allowed to unlock the furniture secured compartment 15 through validated data input.

The first and the second stage may be operable by any locking and unlocking action of the interface block 7 known currently or later developed. In varying embodiments, locking and unlocking actions may be through a near field communication sensor, biometric sensor 9 (fingerprint, eye scan, etc.), key code activated 8, key activated and the like. In most embodiments, the action required by an access sensor 1 during the first stage will be different from the unlocking action for the second stage.

In many embodiments, the security device may have a sliding (11,12) mechanism allowing a portion to slide out away from the furniture in which the security device is installed. This sliding occurs during the first stage upon performing the access step (generally an action such as a button, switch, touch sensor, push sensor or a near field communication sensor, as discussed below). Once the access stage is completed, the security device portion may slide, or otherwise move outward to an access position which provides access to the security components for the unlocking stage. For example, in one embodiment, once slid out, the security device will expose a biometric sensor 9 (such as a fingerprint scanner, and the like), a keypad 8, and a computerized display 10. In this embodiment, instructions and/or status may be provided by the display. The biometric sensor 9 allows the user to scan fingerprints (or other biometric identifying information). The keypad 8 further may allow a user to key in a correct unlocking code. The near field communication sensor may be used to exchange data with an electronic device, such as a mobile phone or any other equipment carrying a compatible near field communication technology and a protocol communication; upon the validated data is received the security device will unlock the secured furniture compartment 15. Depending on embodiment, one or a combination of the biometric sensor 9, the keypad 8 and the near field communication sensor may be used to unlock the furniture compartment and contents within may be accessible. Once done, a user may close the compartment. The security device may then be configured to be automatically or manually locked in place, at which point it may manually or automatically return the security device to its compact state within the furniture.

The locking device of the present invention may be formed of any material or materials capable of securing a compartment. For example, materials of which the locking device may be made include metals, plastics, composites, and the like.

Turning now to FIGS. 1-4, perspective views of an embodiment of the security device in a compact state and removed from a piece of furniture is shown. The security device is formed of a primary block 2 which forms the body and structure of the security device. A locking mechanism 3 allows the device to lock the compartment of the furniture (such as a drawer, cabinet, or the like) in place, maintaining it in a closed, locked position by mating or otherwise attaching to a slot, bar, protrusion, or the like. The locking mechanism 3 includes a gap adjuster block 4 and dead bolt piston 5. However, it should be understood that any sort of locking structure other than a piston may be used. Accordingly, the term "locking piston" is used herein to refer to any locking structure.

Within the intelligent block 3 is a motion control circuitry which may move the locking piston 5 in and out, locking and unlocking the furniture compartment 15, shown in FIGS. 9-10. The intelligent block 3 consists of a motion control system comprising a motion control circuitry and at least two motor devices such as a piezo motor, a solenoid motor, a DC motor, a brushless motor or other like technology. In this embodiment, an access sensor 1 is shown here. The access sensor 1 is positioned on the front of the interface block 7. This access sensor 1 may be able to sense a push, a touch or exchange wireless data using near field communication technology, and upon receipt the access sensor 1 is programmed to send a signal to the computerized electronics control board, which is positioned within the intelligent block 3, to extend or release an interface block 7, shown in FIGS. 5-7.

The access sensor 1 may have plurality of sensors such as touch, push and near field communication sensor on the front of the interface block 7. In one embodiment, the touch sensor may be configured to recognize a sequence of movements in the front of the sensor. In another embodiment, a button or switch may be positioned somewhere in the furniture, acting as a remote button or switch, and upon a mechanical action on it, access may be granted to the access stage components. This remote button or switch may be in connection through radio frequency or wired with the security device. Still other embodiments may utilize a structure allowing a user to push inward on the security device which will then release the interface block 7 outward, exposing the access stage unlocking components manually. It should further be understood that the access sensor 1 only grants access to an interface block 7 of the security device, and its unlocking components. The unlocking actions for the interface block 7 components must be satisfied in order to unlock the dead bolt 5 from the locking slot 14.

Figure 5:
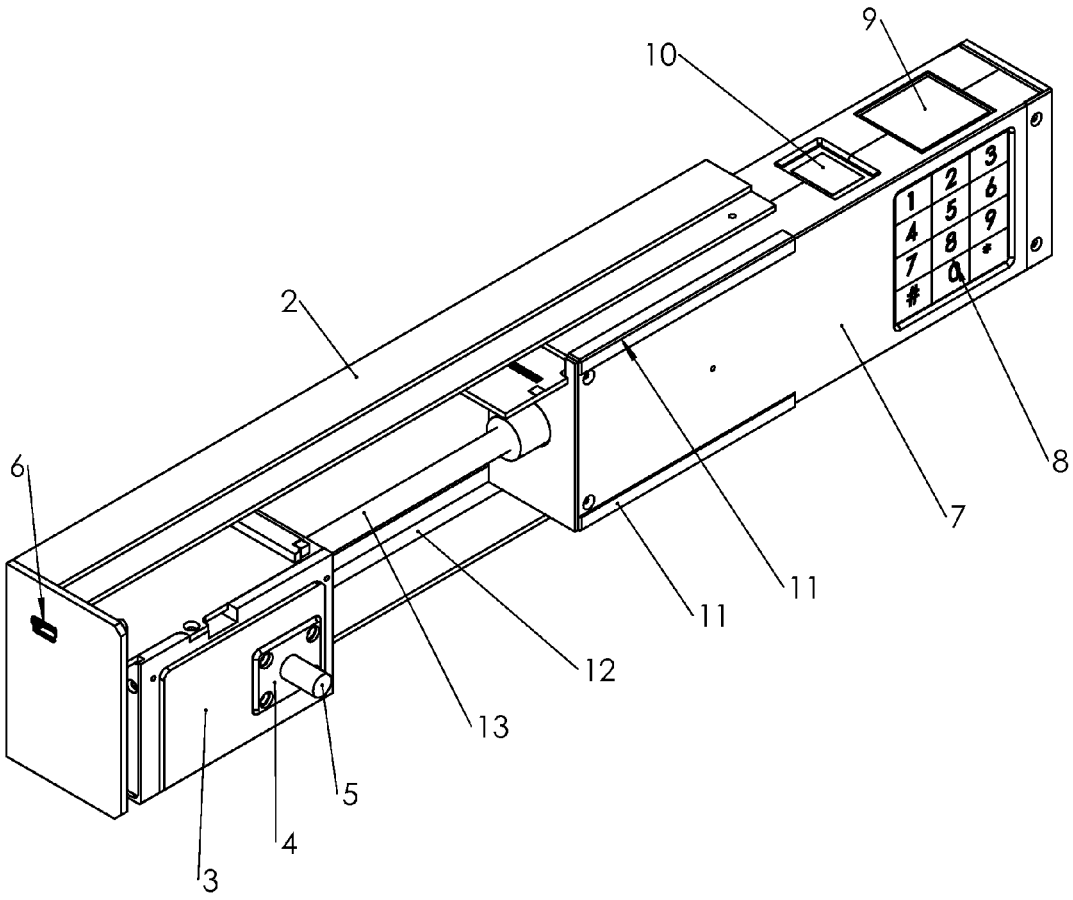
FIG. 5 provides a perspective view of an embodiment of the present invention with an interface block in an access position.
Figure 6:
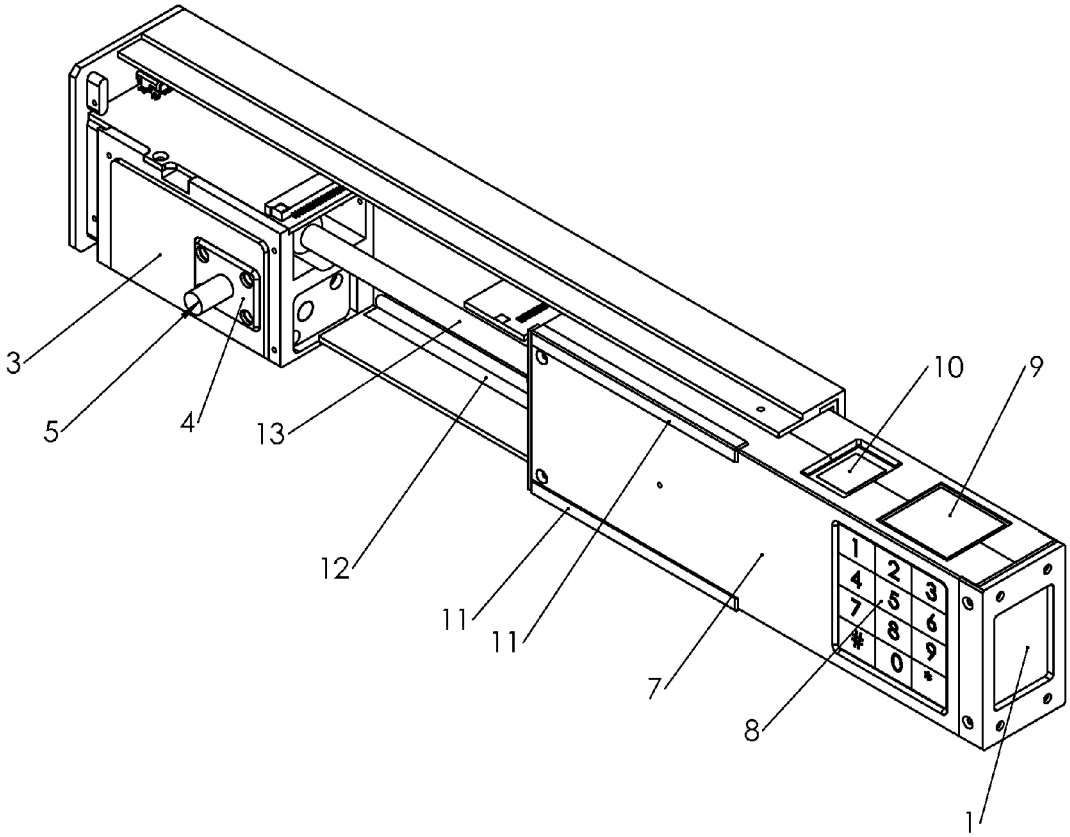
FIG. 6 provides a perspective view of an embodiment of the present invention with an interface block in an access position.
Figure 7:
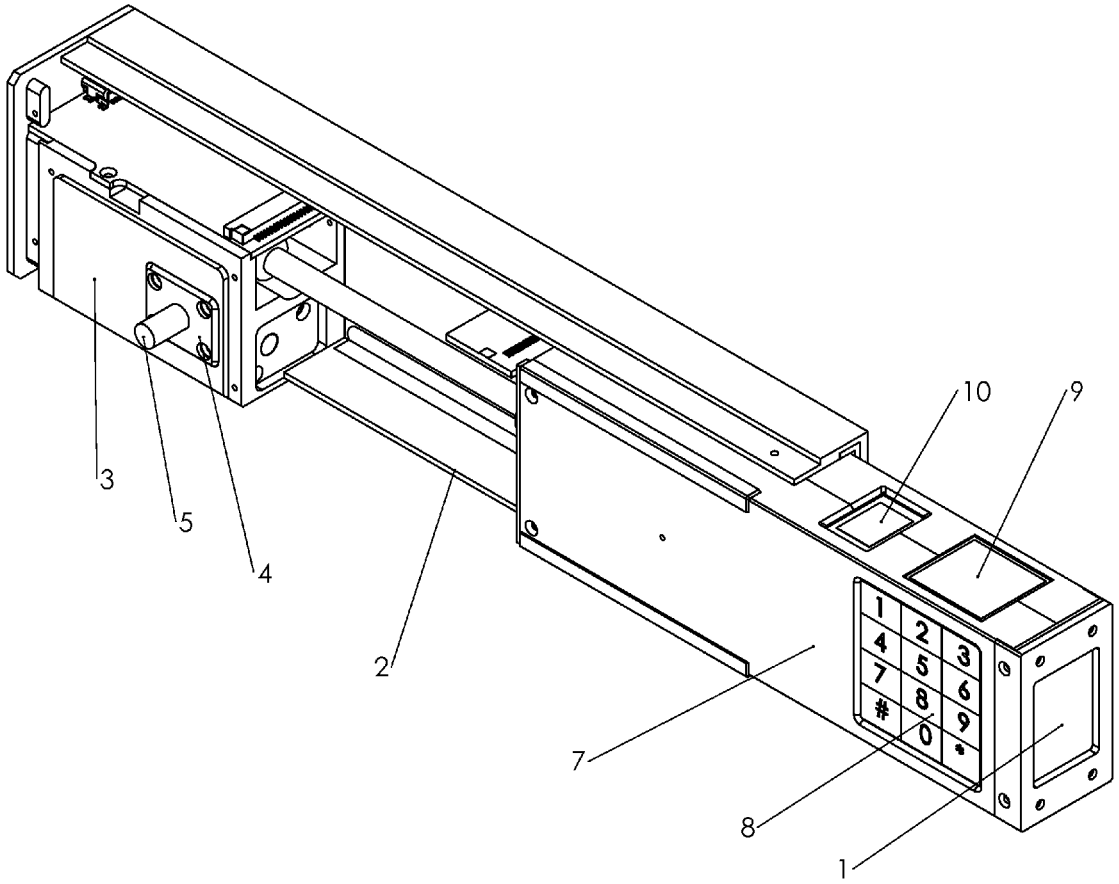
FIG. 7 provides a perspective view of an embodiment of the present invention with an interface block in an access position.

FIGS. 5-7 show another embodiment of the invention in an extended position and with part of a primary block 2 cut away. In this view, an interface block 7 extends outward from the primary block 2 which is shown partially cut away. In this embodiment, the intelligent block 3 controls the movement of the interface block 7, through a mechanical guide 13, which is movable along tracks 12. Similar tracks or rails 11 may be mounted on an opposing side of the interface block 7 which will facilitate movement along the interior of the primary block 2, shown in FIGS. 1-4. However, it should be understood that the interface block 7 may slide on its own, manually, may be spring loaded, or may be controlled by any other movement device such as a gear, screw, and the like.

The interface block 7 has a biometric sensor 9, and keypad 8 on it on which a user may interact. Depending on embodiment, at least one of the biometric sensor 9, the keypad or the near field communication sensor may be used to release the dead bolt 5 and provide access to the furniture compartment 15. In another embodiment, completing a combination of the above may be required. A display 10 may provide visual updates such as locking status, instructions, indications of correct input, and the like. In the frontal views of FIGS. 6 and 7, the access sensor 1 can be seen. FIG. 7 provides a view of the device in an extended position without the primary block 2 cut away. It should be understood that in varying embodiments, a remote sensor such as a button and the like may be used instead of the access sensor 1. Similarly, any unlocking components may be used instead of the biometric sensor 9 and keypad 8 without straying from the scope of the invention.

Figure 8A:
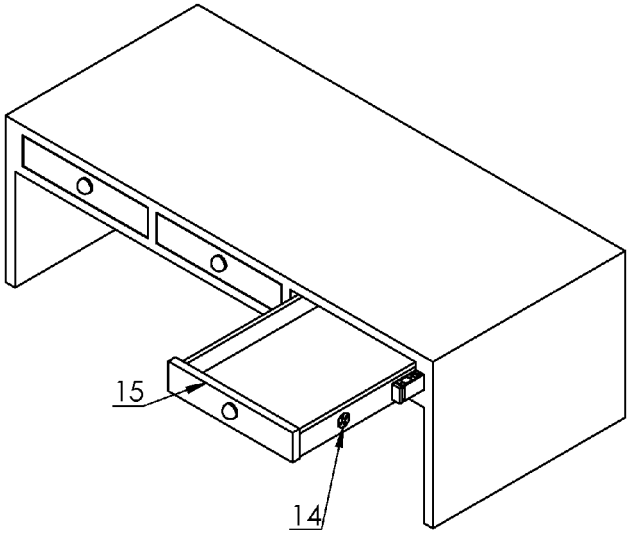
FIGS. 8*a*-*b* provide perspective and elevation views of a furniture with an embodiment of the present invention installed therein.
Figure 8B:
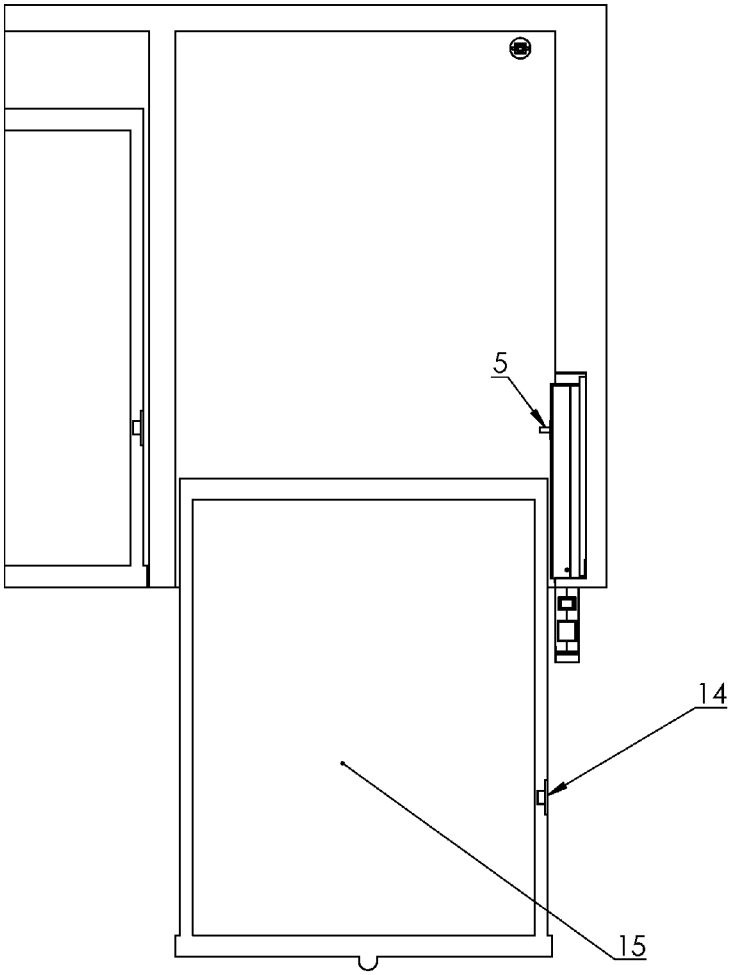

FIGS. 8-10 provide views of the security device installed in a piece of furniture and views of the furniture compartment in locked and unlocked positions. FIGS. 8*a* and 8*b* show perspective and elevation views of the security device installed in a desk, with the interface block 7 in an extended position and the compartment 15, shown here as a drawer, unlocked. The dead bolt 5 of the security device is configured to mate with a locking slot 14 in the desk drawer 15 when in place. In the case of the dead bolt unable to mate with the locking slot 14, the dead bolt will retract and the interface block will remain in access position until the drawer is closed and the dead bolt 5 mates the locking slot 14; upon completion of this the interface block 7 may be retracted such that its front face is flush, or nearly so with a face of the desk.

Figure 9A:
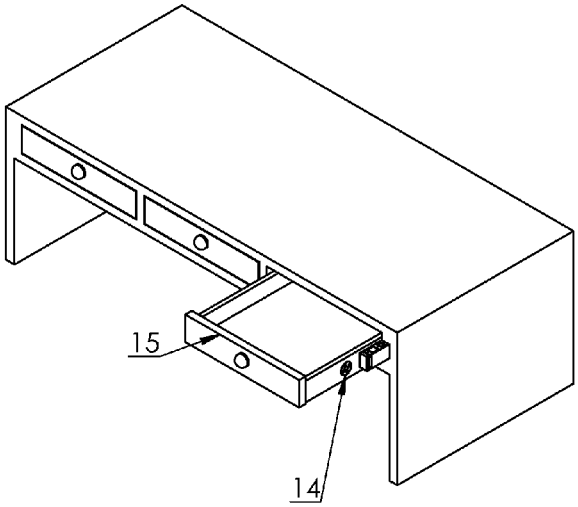
FIGS. 9*a*-9*c* provide perspective, elevation and detail views of a furniture with an embodiment of the present invention installed therein.
Figure 9B:
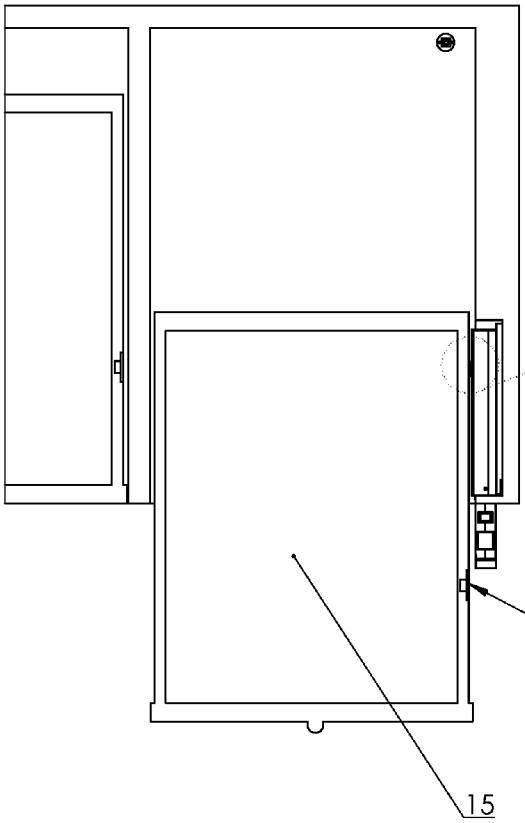
Figure 9C:
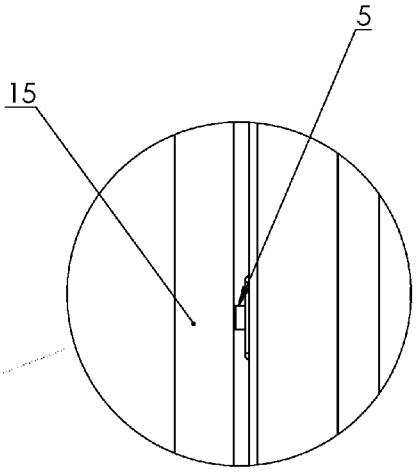

FIGS. 9*a-c* show perspective, elevation and detail views of the compartment 15 in a partially closed position passing over a retracted dead bolt 5. In this embodiment, the security device is unlocked (dead bolt retracted) and the compartment 15 may move freely between an open and closed position. In this view, the interface block 7 remains extended to remind a user that the compartment 15 in unlocked.

FIGS. 10*a-c* show the compartment 15 in a closed and locked position with the deadbolt 5 mating with the locking slot 14, anchoring the compartment 14 in place. In one embodiment, upon the engagement of the dead bolt 5 with the locking slot 14, an automatic retraction or manually pushing of the interface block 7 back into the furniture occurs.

When seeking to engage the piston with the locking slot 14, the dead bolt 5 may be biased in its outward locking position by a spring, motor, or other source. In another embodiment, the locking device may have a sensor to identify when the slot 14 is aligned with the dead bolt 5, and may at this point move the dead bolt outward into its locked positioned.

Figures 11A, 11B:
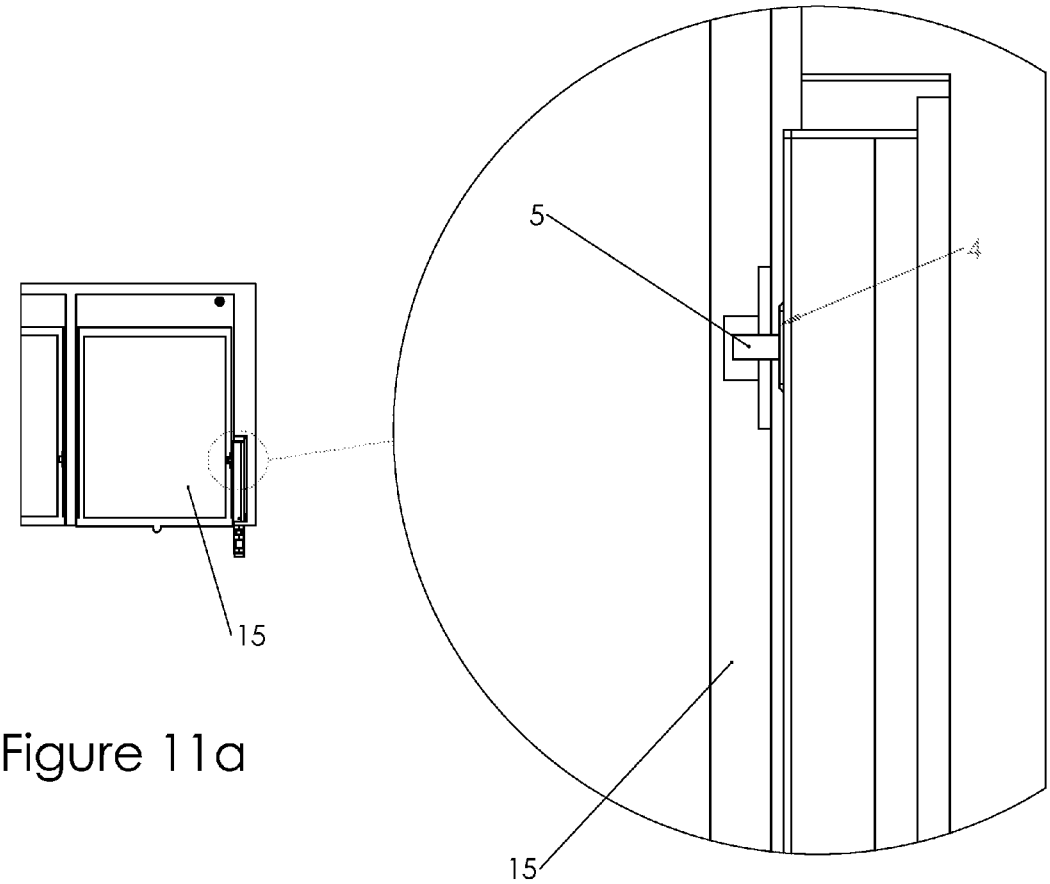
FIGS. 11*a* and 11*b* provide perspective, elevation and detail views of a furniture compartment with an embodiment of the present invention installed therein.
Figure 12A:
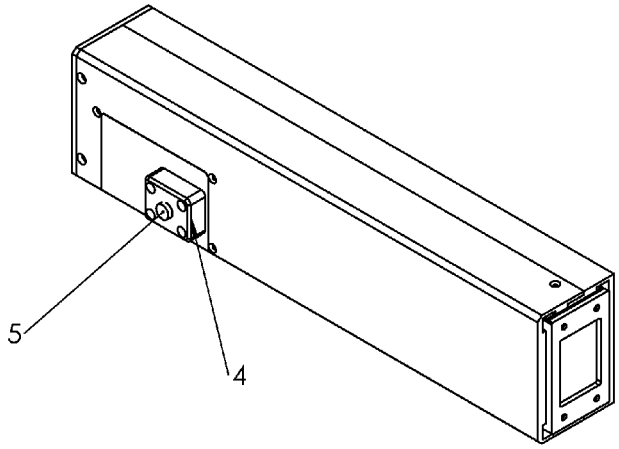
FIGS. 12*a*-12*c* provide perspective, elevation and detail views of a furniture compartment with an embodiment of the present invention installed therein.
Figure 12B:
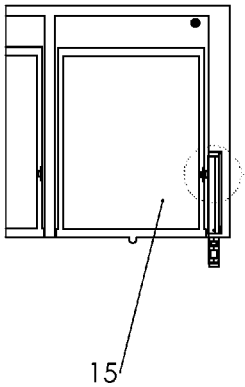
Figure 12C:
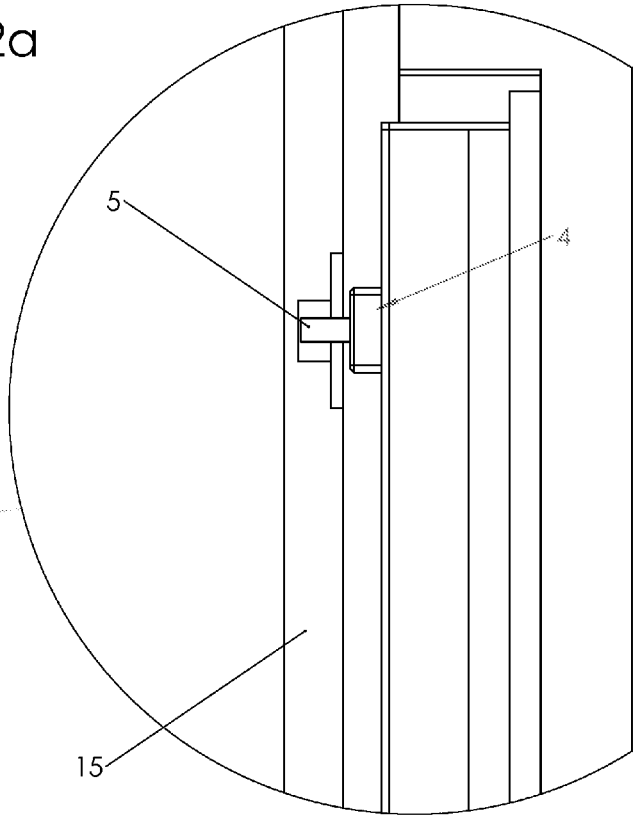

FIGS. 11-12 show the gap adjuster block 4 adapted to the distance between the security device and the lateral wall of the furniture compartment 15. The gap adjuster block 4 is adjustable to distances such as: the lateral wall, facing the security apparatus, of the furniture compartment 15 to the security device, as shown in FIGS. 11*b* and 12*c*.

In further embodiments, the present invention may omit the primary block 2, and utilize only the interface block 7, with the primary block 2 elements being integrated into the furniture.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A security device comprising:

a primary block defining an exterior structure of the security device;

a locking piston on an exterior of the primary block, and movable between a locked position, and an unlocked position, the locking piston configured to mate with a locking slot of a furniture;

an interface block positioned within the primary block when in a home position, and partially extendable out of the primary block when in an access position, the interface block comprising:

at least one of a keypad configured to receive a keyed input and a biometric sensor configured to receive a biometric input; and a display in communication with the at least one of the keypad and the biometric sensor;

a first access sensor configured to bring the interface block to the access position when activated; and wherein upon an activation of the first access sensor, the interface block is moved to the access position, providing access to the at least one of the keypad and the biometric sensor, and the display, and wherein upon an activation of the at least one of the keypad and the biometric sensor, the locking piston is configured to move to the unlocked position.

2. The security device of claim 1 wherein the interface block comprises both of the keypad and the biometric sensor.

3. The security device of claim 2 further comprising a computerized controller positioned within the primary block, configured to receive an input from the first access sensor, the keypad, and the biometric sensor, and configured to release the interface block upon the input to the first access sensor, and configured to move the locking piston to the unlocked position upon the input to the at least one of the keypad and the biometric sensor.

4. The security device of claim 1 further comprising a power input.

5. The security device of claim 1 wherein the first access sensor is a near field communication sensor.

6. The security device of claim 1 wherein the first access sensor is programmed to be activated upon receiving a specific motion input.

7. The security device of claim 1 wherein the interface block cannot move to the home position when the locking piston is in the unlocked position.

8. The security device of claim 1 wherein the first access sensor is one of a switch or button.

9. The security device of claim 1 further comprising a motorized piston configured to move the interface block from the home position to the access position.

10. The security device of claim 1 further comprising a plurality of tracks or rails positioned between the primary block and the interface block, the interface block movable along the plurality of tracks or rails between the home and access positions.

11. The security device of claim 1 wherein the locking piston comprises a motor configured to move it between the locked and unlocked positions.

12. A furniture having the security device of claim 1 installed, wherein the locking piston is engaged with a slot of a drawer of the furniture when in the locked position and disengaged from the slot when in the unlocked position, and wherein the interface block is extended out of, and away from, the furniture when in the access position.

13. The furniture of claim 12 wherein the furniture is a desk.

14. The furniture of claim 12 wherein the furniture is a dresser.

15. The furniture of claim 12 wherein the furniture is a jewelry box.

16. A furniture having the security device of claim 1 installed, wherein the locking piston is engaged with a slot of a door of the furniture when in the locked position and disengaged from the slot when in the unlocked position, and wherein the interface block is extended out of, and away from, the furniture when in the access position.

17. The furniture of claim 16 wherein the furniture is a desk.

18. The furniture of claim 16 wherein the furniture is a dresser.

19. The furniture of claim 16 wherein the furniture is a jewelry box.

20. A method of operation of the furniture of claim 12 comprising the steps of:

activating the first access sensor, causing the interface block to move to its access position from the home position;

activating the at least one of the biometric sensor and the keypad;

moving automatically the locking piston from the locked position to the unlocked position based on the activation of the at least one of the biometric sensor and the keypad, the moving being controlled by a motorized controller in communication with the at least one of the biometric sensor and the keypad;

opening the drawer of the furniture after the locking piston is retracted from the slot in the drawer;

closing the drawer;

moving automatically the locking piston from the unlocked position to the locked position when the slot is aligned with the locking piston;

returning the interface block to the home position after the locking piston is in the locked position.

* * * * *